US007880716B2

(12) United States Patent
Tanaka et al.

(10) Patent No.: US 7,880,716 B2
(45) Date of Patent: Feb. 1, 2011

(54) LIQUID CRYSTAL DISPLAY DEVICE

(75) Inventors: Yukio Tanaka, Kanazawa (JP); Tetsuo Fukami, Ishikawa-gun (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 762 days.

(21) Appl. No.: 11/873,268

(22) Filed: Oct. 16, 2007

(65) Prior Publication Data

US 2008/0259016 A1 Oct. 23, 2008

(30) Foreign Application Priority Data

Oct. 17, 2006 (JP) ..... 2006-282953

(51) Int. Cl.
*G09G 3/36* (2006.01)

(52) U.S. Cl. ..... 345/103; 345/96

(58) Field of Classification Search ..... 345/87, 345/94–96, 98–100, 209
See application file for complete search history.

(56) References Cited

U.S. PATENT DOCUMENTS 5,162,932 A * 11/1992 Kobayashi et al. ..... 345/96
6,903,716 B2 * 6/2005 Kawabe et al. ..... 345/99
7,129,998 B2 * 10/2006 Ohgiichi et al. ..... 349/40
7,161,576 B2 * 1/2007 Kawabe et al. ..... 345/99

FOREIGN PATENT DOCUMENTS

JP 2003-167556 6/2003
JP 2003-255907 9/2003
JP 2003-295834 10/2003

OTHER PUBLICATIONS

Communication from Japanese Patent Office, Notification of Reasons for Rejection in co-pending Japanese Patent Application No. 2006-282953 mailed Jan. 29, 2009, with English language translation (7 pages).

* cited by examiner

*Primary Examiner*—Ricardo L Osorio
(74) *Attorney, Agent, or Firm*—Finnegan, Henderson, Farabow, Garrett & Dunner, L.L.P.

(57) ABSTRACT

A liquid crystal display device includes liquid crystal pixels, signal line groups each including a predetermined number of signal lines, and a drive circuit which selects the pixels on a row-by-row basis and drives the pixels of the selected row via the signal lines. The drive circuit includes a signal line driver which outputs a predetermined number of pixel voltages for each group driving period while the pixels of each row are being selected, a multiplexer which distributes to each signal line group the pixel voltages output from the signal line driver, and a controller which controls the multiplexer to electrically connect all of the signal line groups to the signal line driver and electrically disconnect the signal line groups one by one from the signal line driver for each group driving period, in a selection period of the pixels of an initial row that requires polarity inversion.

7 Claims, 9 Drawing Sheets

LIQUID CRYSTAL DISPLAY DEVICE

CROSS-REFERENCE TO RELATED APPLICATIONS

This application is based upon and claims the benefit of priority from prior Japanese Patent Application No. 2006-282953, filed Oct. 17, 2006, the entire contents of which are incorporated herein by reference.

BACKGROUND OF THE INVENTION

1. Field of the Invention

The present invention relates to a liquid crystal display device which includes a plurality of liquid crystal pixels arrayed substantially in a matrix and drives the liquid crystal pixels of each row in at least two steps, and more particularly to a liquid crystal display device in which liquid crystal driving voltages for the liquid crystal pixels are set at opposite polarities in every predetermined number of rows.

2. Description of the Related Art

Liquid crystal display devices have widely been used to display images in computers, car navigation systems or TV receivers.

A liquid crystal display device, in general, includes a liquid crystal display panel having a structure that a liquid crystal layer is held between an array substrate and a counter-substrate. In an active-matrix liquid crystal display panel, an array substrate includes a plurality of pixel electrodes which are arrayed substantially in a matrix, a plurality of scanning lines which are disposed along the rows of pixel electrodes, a plurality of signal lines which are disposed along the columns of pixel electrodes, and a plurality of pixel switching elements which are disposed near intersections between the scanning lines and signal lines. The scanning lines are sequentially driven by a scanning line driver disposed adjacent to one ends of the scanning lines. The signal lines are driven by a signal line driver disposed adjacent to one ends of the signal lines, while each scanning line is being driven. Each of the pixel switching elements is composed of, e.g. a thin-film transistor, and turned on to apply the potential of the associated signal line to the associated pixel electrode when the associated scanning line is driven. On the counter-substrate, a common electrode is provided so as to face the pixel electrodes. A pair of the pixel electrode and the common electrode serves as a liquid crystal pixel in associated with a pixel region that is part of the liquid crystal layer between the pixel electrode and the common electrode. In each liquid crystal pixel, the alignment of liquid crystal molecules in the pixel region is controlled by an electric field corresponding to a liquid crystal driving voltage that is a potential difference between the pixel electrode and the common electrode.

In the conventional art, there has been proposed a technique of driving liquid crystal pixels of each row in two steps, thereby to reduce the circuit scale of a signal line driver (see, e.g. Jpn. Pat. Appln. KOKAI Publication No. 2003-295834). In this technique, for example, as shown in FIG. 9, analog switches ASW1, ASW2, ASW3, ASW4, . . . , are provided as a multiplexer between output buffers D1, D2, . . . , of the signal line driver and signal lines X1, X2, X3, X4 . . . . The analog switches ASW1, ASW4, . . . , are controlled by a control signal CTL0, and the analog switches ASW2, ASW3, . . . , are controlled by a control signal CTL1. Transitions of the control signal CTL0 and control signal CTL1 are shown in FIG. 10.

The analog switches ASW1 and ASW4 are simultaneously turned on upon a fall of the control signal CTL0, so as to electrically connect the output buffers D1 and D2 of the signal line driver to the signal lines X1 and X4. The analog switches ASW2 and ASW3 are simultaneously turned on upon a fall of the control signal CTL1, so as to electrically connect the output buffers D1 and D2 of the signal line driver to the signal lines X3 and X2. Specifically, if the transitions of the control signals CTL0 and CTL1 are determined to alternately turn on the analog switches ASW1 and ASW4 and the analog switches ASW2 and ASW3 during the period in which each of the scanning lines Y1, Y2, Y3, Y4, . . . , is driven, the liquid crystal pixels PX of the associated row are driven in two steps. In this structure, the necessary number of output buffers D1, D2, . . . , of the signal line driving circuit is only half the number of signal lines X1, X2, X3, X4, . . . . Therefore, the circuit scale of the signal line driver can be reduced. The actual signal line driver is composed of driver ICs each having a predetermined number of output buffers. As a result, the number of driver ICs is reduced. In FIG. 9, the signal lines X2 and X3 are connected to the analog switches ASW3 and ASW2 in a crossed fashion. This structure is effective in the case where the liquid crystal driving voltages to the liquid crystal pixels PX of each row, that is the potentials of pixel electrodes PE relative to the potential of the common electrode CE are set at opposite polarities on a column-by-column basis. In other words, relative to the polarities of pixel voltages Vs which are output from the output buffers D1 and D2 in a first driving step, there is no need to invert the polarities of pixel voltages Vs which are output in a second driving step. Therefore, the power consumption of the signal line driver and the charging error can be reduced.

As a measure for preventing fluctuations in brightness, which is called "flicker", pixel voltages are set at opposite polarities on a row-by-row basis, for example. In particular, there is a problem that the flicker becomes conspicuous at a time of displaying a checkered crosshatch-dot pattern. To solve this problem, it is preferable to set the pixel voltages at opposite polarities in units of a predetermined number of at least two pixel rows. In the case where the predetermined number of pixel rows are four pixel rows, as show in FIG. 9, the potential polarities of the signal lines X1 to X4 transition in every four horizontal scanning periods (4H), as shown in FIG. 10.

However, this polarity control may cause unwanted potential variation in the signal lines X1, X4, . . . . In the case where the control signals CTL0 and CTL1 transition in the first half and second half of each horizontal scanning period, as shown in FIG. 10, the signal lines X1 and X4 are connected to the output buffers D1 and D2 of the signal line driver while the signal lines X2 and X3 are in the floating state, and the signal lines X2 and X3 are connected to the output buffers D2 and D1 of the signal line driver while the signal lines X1 and X4 are in the floating state. Each pixel electrode PE retains the potential that is set via an associated pixel switching element T. Subsequently, as shown in FIG. 9, a parasitic capacitance Csd-R and a parasitic capacitance Gsd-L appears between the pixel electrode PE and the right-hand neighboring signal line X and between the pixel electrode PE and the left-hand neighboring signal line X. In this case, when the control signal CTL1, as encircled in FIG. 10, falls in the second half of the 1 horizontal scanning period for a pixel line L1, which is the first one of four rows of liquid crystal pixels PX, the potential of the signal line X2 transitions from the positive polarity to the negative polarity due to the polarity inversion of the pixel voltage Vs that is output from the output buffer D2, and the potential of the signal line X3 transitions from the negative polarity to the positive polarity due to the polarity inversion of the pixel voltage Vs that is output from the output buffer D1.

At this time, the potential of the signal line X1 is affected by the potential variation of the signal line X2 due to the presence of a capacitance-coupled path which extends from the signal line X2 to the signal line X1 via the parasitic capacitance Csd-R, the pixel electrode PE in the potential-retention state and the parasitic capacitance Csd-L. In addition, the potential of the signal line X4 is affected by the potential variation of the signal line X3 due to the presence of a capacitance-coupled path which extends from the signal line X3 to the signal line X4 via the parasitic capacitance Csd-L, the pixel electrode PE in the potential-retention state and the parasitic capacitance Csd-R. Specifically, variation occurs in the potentials of the pixel electrodes PE which are connected to the signal lines X1 and X4 via pixel switching elements T in the pixel line L1. The potentials that have varied are retained in the pixel electrodes PE when all the pixel switching elements T for the pixel line L1 are simultaneously turned off. As a result, as shown in FIG. 11, horizontal stripes with two-dot intervals occur in every four pixel rows on the display screen. In this case, the gradations of all pixels are set at equal levels in order to make it easier to observe horizontal stripes. Such horizontal stripes occur not only in the case where pixel voltages Vs are set at opposite polarities in every four pixel rows, but also in the case where pixel voltages Vs are set at opposite polarities, for example, in every two pixel rows or every three pixel rows.

BRIEF SUMMARY OF THE INVENTION

An object of the present invention is to provide a liquid crystal display device which can prevent horizontal stripes which occur in the case where liquid crystal pixels of each of rows are driven in at least two driving steps.

According to an aspect of the present invention, there is provided a liquid crystal display device comprising: a plurality of liquid crystal pixels which are arrayed substantially in a matrix; a plurality of signal line groups each including a predetermined number of signal lines which are arranged along the columns of liquid crystal pixels; and a drive circuit which selects the liquid crystal pixels on a row-by-row basis and drives the liquid crystal pixels of the selected row via the signal lines; wherein the drive circuit includes: a signal line driver which outputs a predetermined number of pixel voltages, which are assigned to the predetermined number of signal lines included in each of the signal line groups, in a parallel fashion for each group driving period while the liquid crystal pixels of each row are being selected; a multiplexer which distributes to each of the signal line groups the predetermined number of pixel voltages output from the signal line driver in the cycle of group driving period; and a controller which controls, in a case where output voltage polarities of the signal line driver are to be inverted in units of a predetermined number of pixel rows, the multiplexer to electrically connect all of the signal line groups to the signal line driver and electrically disconnect the signal line groups one by one from the signal line driver in a sequential fashion for each group driving period, in a selection period of the liquid crystal pixels of an initial row that requires polarity inversion.

With this liquid crystal display device, in the case where output voltage polarities of the signal line driver are to be inverted in units of a predetermined number of pixel rows, the multiplexer electrically connects all of the signal line groups to the signal line driver and then electrically disconnects the signal line groups one by one from the signal line driver in a sequential fashion for each group driving period, in a selection period of the liquid crystal pixels of an initial row that requires polarity inversion. Thereby, the predetermined number of signal lines included in each of the signal line groups are uniformly driven by the predetermined number of pixel voltages that are initially output from the signal line driver in the selection period, and the polarities of the potentials of these signal lines are inverted. When one of the signal line groups is electrically disconnected from the signal line driver at the end of a first period which is equal to the group driving period, the potentials of the predetermined number of signal lines included in this signal line group are set to be equal to the predetermined number of pixel voltages that are assigned to these signal lines. Subsequently, the predetermined number of pixel voltages are output in parallel from the signal line driver for each group driving period, and the predetermined signal lines included in each of the other signal line groups are uniformly driven by the predetermined pixel voltages. These other signal line groups are electrically disconnected one by one from the signal line driver for each group driving period. Thus, the potentials of the predetermined number of signal lines included in the disconnected signal line group are set to be equal to the predetermined number of pixel voltages that are assigned to these signal lines. In other words, until a first one of the signal line groups is electrically disconnected from the signal line driver, the polarity inversion for all the signal lines in this signal line group is completed, and the potentials of the predetermined number of signal lines included in the other signal line groups vary for each group driving period until the potentials become equal to the predetermined number of pixel voltages that are assigned to these signal lines. With the above-described driving scheme, even if the signal lines groups are capacitive-coupled to each other, the potentials of the signal line group, which are earlier set in the floating state, do not greatly vary due to the polarity inversion of the potentials of the other signal line groups. Therefore, the occurrence of horizontal stripes can be prevented in the case of driving the liquid crystal pixels of each row in at least two driving steps.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A liquid crystal display device according to a first embodiment of the present invention will now be described with reference to the accompanying drawings.

Figure 1:
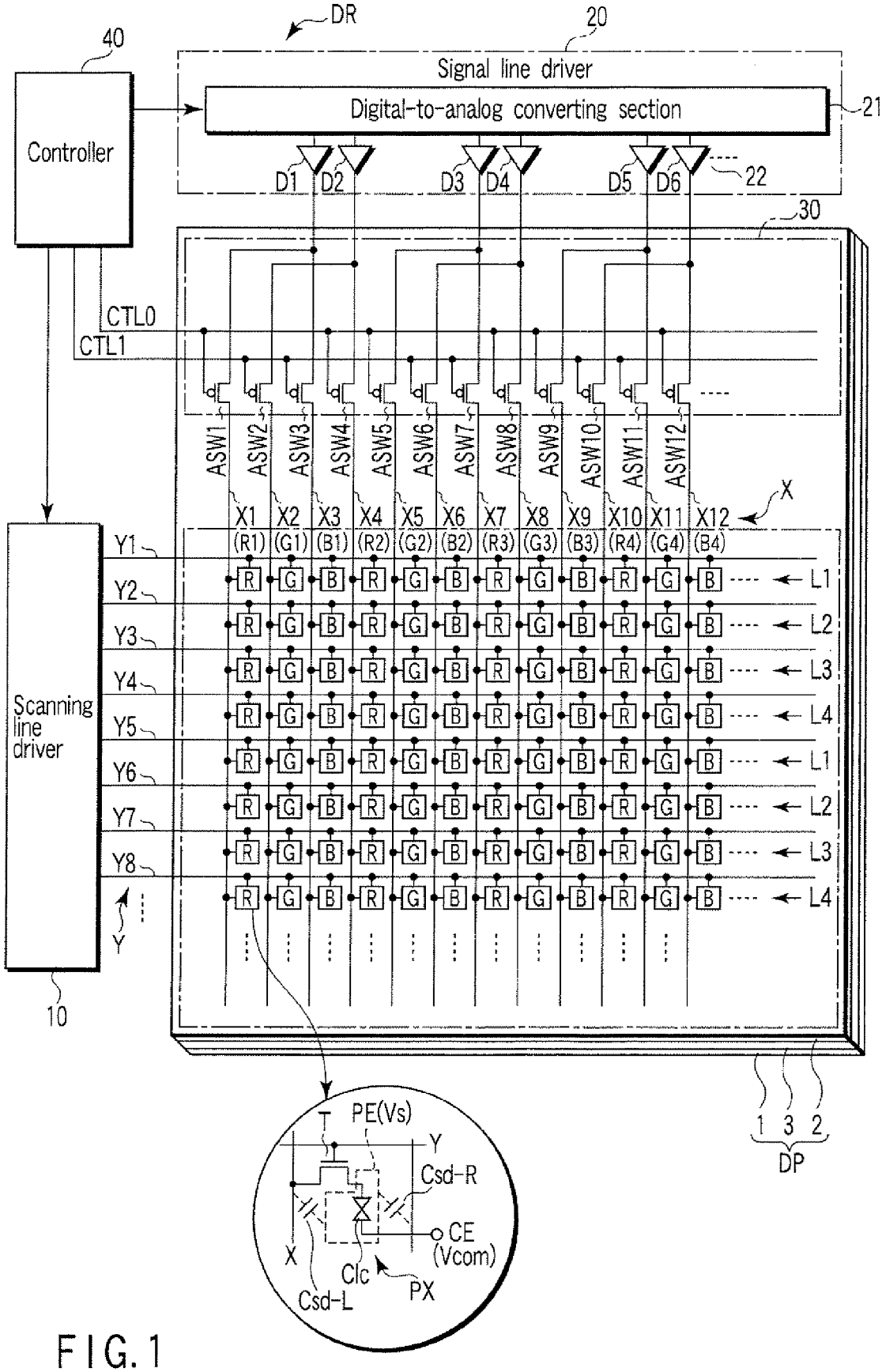
FIG. 1 schematically shows the circuit structure of a liquid crystal display device according to a first embodiment of the present invention.
Figure 2:
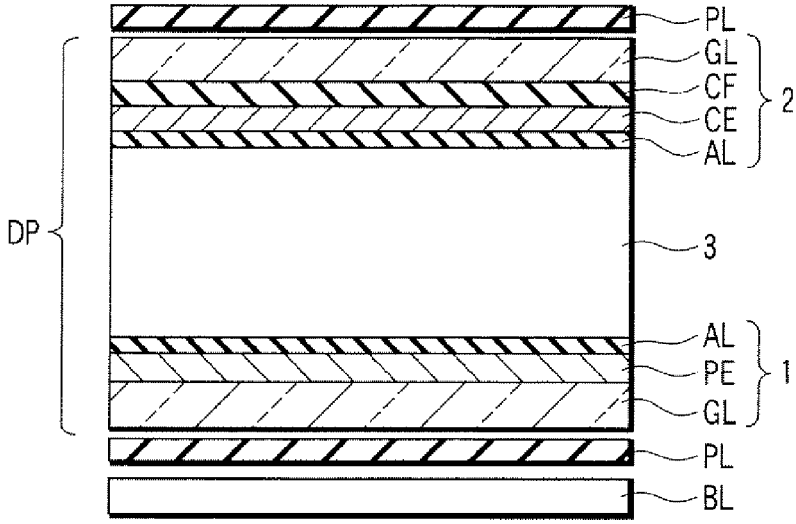
FIG. 2 schematically shows the cross-sectional structure of a liquid crystal display panel shown in FIG. 1.

FIG. 1 schematically shows the circuit structure of the liquid crystal display device, and FIG. 2 schematically shows a cross-sectional structure of a liquid crystal display panel shown in FIG. 1. The liquid crystal display device includes, for example, a normally-white liquid crystal display panel DP. The liquid crystal display panel DP has such a structure that a liquid crystal layer 3 is held between a pair of electrode substrates, i.e. an array substrate 1 and a counter-substrate 2.

The array substrate 1 includes a transparent insulating substrate CL that is formed of, e.g. a glass plate, a plurality of pixel electrodes PE formed on the transparent insulating substrate GL, and an alignment film AL formed on the pixel electrodes PE. The counter-substrate 2 includes a transparent insulating substrate GL that is formed of, e.g. a glass plate, a color filter CF formed on the transparent insulating substrate GL, a common electrode CE formed on the color filter CF, and an alignment film AL formed on the common electrode CE. The liquid crystal layer 3 is obtained by filling a liquid crystal material in a gap between the counter-substrate 2 and array substrate 1. A pair of polarizers PL are provided on the outsides of the liquid crystal display panel DP. A backlight BL is provided on the outside of the polarizer PL that is located on the array substrate 1 side.

In the array substrate 1, the pixel electrodes PE are arrayed substantially in a matrix. In addition, a plurality of scanning lines Y (Y1, Y2, Y3, . . . ) are disposed along the rows of pixel electrodes PE, a plurality of signal lines X (X1, X2, X3, . . . ) are disposed along the columns of pixel electrodes PE, and a plurality of pixel switching elements T are disposed near intersections between the scanning lines Y and signal lines X. Each of the pixel switching elements T is composed of a thin-film transistor which has a gate connected to the scanning line Y, and a source-drain path connected between the signal line X and pixel electrode PE. When the pixel switching element T is driven via the associated scanning line Y, the pixel switching element T is turned on to apply the potential of the associated signal line X to the associated pixel electrode PE.

The pixel electrodes PE and the common electrode CE are formed of a transparent electrode material such as ITO, and are covered with the alignment films AL. The pixel electrodes PE and the common electrode CE constitute liquid crystal pixels PX along with pixel regions that are parts of the liquid crystal layer 3. Each of the liquid crystal pixels PX has a liquid crystal capacitance Clc between the pixel electrode PE and the common electrode CE. Liquid crystal molecular alignment in the pixel region is controlled by an electric field corresponding to a liquid crystal driving voltage that is retained in the liquid crystal capacitance Clc as a potential difference between the pixel electrode PE and the common electrode CE.

The color filter layer CF includes stripe-shaped red color layers, green color layers and blue color layers, which are repeatedly arranged in the row direction so as to be opposed to the columns of pixel electrodes PE. The red color layers are opposed to the pixel electrodes PE of a first column, a fourth column, a seventh column, . . . , thereby causing the liquid crystal pixels PX corresponding to these pixel electrodes PE to serve as red pixels R that constitute red pixel columns R1, R2, R3, . . . . The green color layers are opposed to the pixel electrodes PE of a second column, a fifth column, an eighth column, . . . , thereby causing the liquid crystal pixels PX corresponding to these pixel electrodes PE to serve as green pixels G that constitute green pixel columns G1, G2, G3, . . . . The blue color layers are opposed to the pixel electrodes PE of a third column, a sixth column, a ninth column, . . . , thereby causing the liquid crystal pixels PX corresponding to these pixel electrodes PE to serve as blue pixels B that constitute blue pixel columns B1, B2, B3, . . . .

The liquid crystal display further includes a drive circuit DR which selects the liquid crystal pixels PX on a row-by-row basis and drives the liquid crystal pixels PX of the selected row via the signal lines X. The drive circuit DR includes a scanning line driver 10, a signal line driver 20, a multiplexer 30 and a controller 40. For example, as shown in FIG. 1, the scanning line driver 10, signal line driver 20 and controller 40 are provided outside the liquid crystal display panel DP, and the multiplexer 30 is provided on the liquid crystal display panel DP. In this case, the signal lines X1, X2, X3, X4, . . . , are classified by the multiplexer 30 into a plurality of signal line groups each including a predetermined number of signal lines, for example, two signal line groups (signal lines X1, X4, X5, X8, . . . ; and signal lines X2, X3, X6, X7, . . . ). The scanning line driver 10 is configured to sequentially drive the scanning lines Y and to select the liquid crystal pixels PX on a row-by-row basis. The signal line driver 20 is configured to output a plurality of pixel voltages Vs, which are assigned to the first signal line group (signal lines X1, X4, X5, X8, . . . ) and the second signal line group (signal lines X2, X3, X6, X7, . . . ) in a parallel fashion for each group driving period G while the liquid crystal pixels PX of each row are being selected. The multiplexer 30 is configured to distribute to each of the first and second signal line groups a predetermined number of pixel voltages Vs (the predetermined number=a fraction of an integer number of 2 or more (a half (½) in this example) with respect to the total number of signal lines X1, X2, X3, . . . ) which are output from the signal line driver 20 for each group driving period G. The output voltage polarities of the signal line driver 20 are inverted in every predetermined number of pixel rows, for example, in every four pixel rows. In addition to the control of operating the scanning line driver 10 and signal line driver 20 as described above, the controller 40 executes the following control of the multiplexer 30. That is, the controller 40 controls the multiplexer 30 to electrically connect all of the first and second signal line groups to the signal line driver 20 and electrically disconnect the first and second signal line groups one by one from the signal line driver 20 in a sequential fashion for each group driving period, in the selection period of the liquid crystal pixels PX of the initial row that requires polarity inversion. Further, the controller 40 controls the multiplexer 30 to electrically connect and disconnect the first and second signal line groups to/from the signal line driver 20 one by one in a sequential fashion for each group driving period, in the selection period of the liquid crystal pixels PX of a row that requires no polarity inversion.

The signal line driver 20 is composed of, e.g. a plurality of driver ICs. The signal line driver 20 includes a digital-to-analog converting section 21 which converts a digital video signal, which is supplied for each signal line group from the controller 40, to a predetermined number of pixel voltages Vs, and an output buffer section 22 which outputs the predetermined number of pixel voltages Vs obtained from the D/A converting section 21. The output buffer section 22 includes, a predetermined number of output buffers D1, D2, D3, D4, . . . , as output terminals of the signal line driver 20, wherein the predetermined number is a fraction of an integer of the total number of signal lines X1, X2, X3, . . . . The multiplexer 30 is configured such that a pair of pixel voltages having the same polarity and output separately by two output operations of each of the output buffers D1, D2, D3, D4, . . . , are distributed via a pair of analog switches to two signal lines provided for the columns of same polarity pixels present on every other column. The multiplexer 30 is controlled to turn on all the analog switches for a first half of the selection period of the liquid crystal pixels PX of the initial row, i.e. the pixel line L1, and to apply pixel voltages output from each output buffer meanwhile, thereby simultaneously inverting the polarities of corresponding two signal line potentials. Specifically, the multiplexer 30 includes a plurality of analog switches ASW1, ASW2, ASW3, ASW4, . . . , which are assigned to the signal lines X1, X2, X3, X4, . . . , respectively. Each of the analog switches ASW1, ASW2, ASW3, ASW4, . . . , is composed of, e.g. a P-channel thin-film transistor. For example, the analog switches ASW1, ASW4, ASW5, ASW8, ASW9, ASW12, . . . , are connected between the signal lines X1, X4, X5, X8, X9, X12, . . . , of the first signal line group and the output buffers D1, D2, D3, D4, D5, D6, . . . , and are controlled by a control signal CTL0 supplied from the controller 40. The other analog switches ASW2, ASW3, ASW6, ASW7, ASW10, ASW11, . . . , are connected between the signal lines X2, X3, X6, X7, X10, X11, . . . , of the second signal line group and the output buffers D1, D2, D3, D4, D5, D6, . . . , and are controlled by a control signal CTL1 supplied from the controller 40. For example, if the control signal CTL0 falls, all the analog switches ASW1, ASW4, ASW5, ASW8, ASW9, ASW12, . . . , are turned on, thereby electrically connecting the signal lines X1, X4, X5, X8, X9, X12, . . . , to the output buffers D1, D2, D3, D4, D5, D6, . . . . On the other hand, if the control signal CTL1 falls, all the analog switches ASW2, ASW3, ASW6, ASW7, ASW10, ASW1, . . . , are turned on, thereby electrically connecting the signal lines X2, X3, X6, X7, X10, X11, . . . , to the output buffers D1, D2, D3, D4, D5, D6, . . . .

Figure 3:
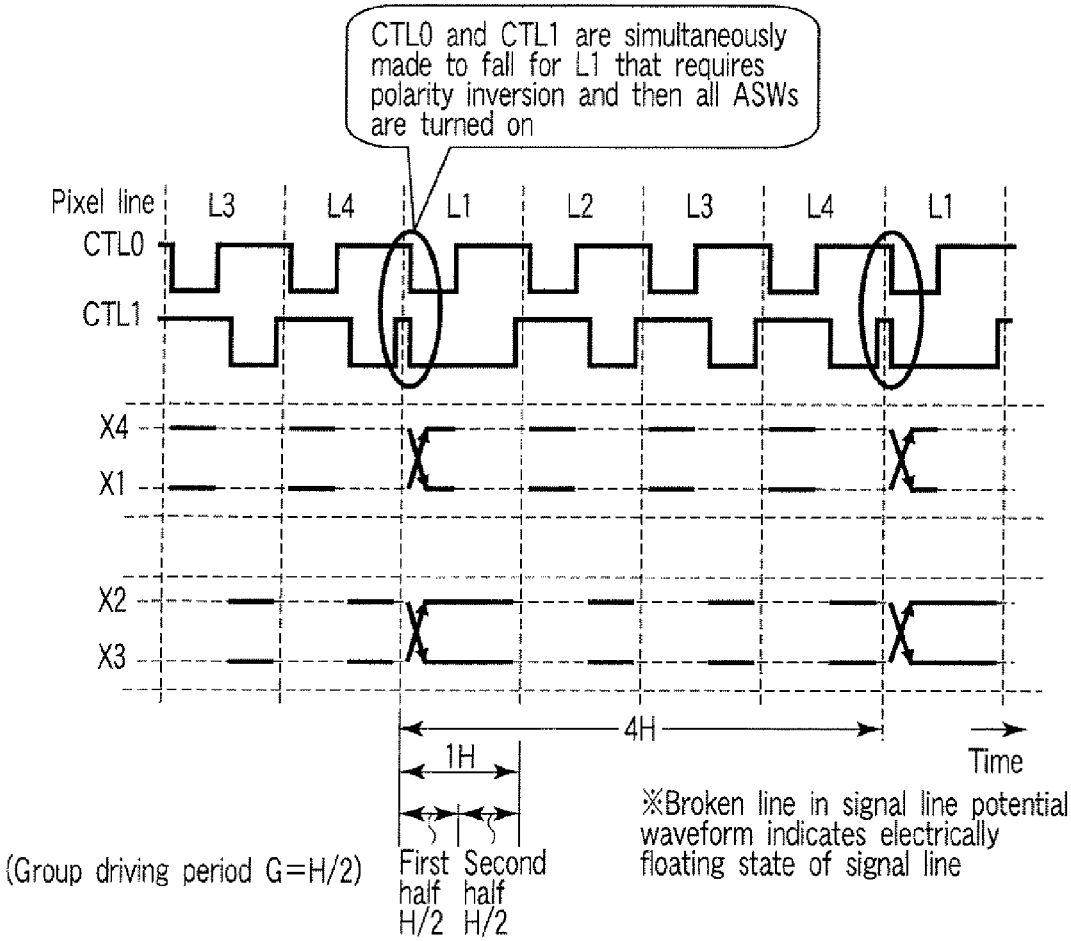
FIG. 3 is a waveform diagram showing potential variations in four signal lines, which occur due to the control of a multiplexer shown in FIG. 1.

As shown in FIG. 3, in the selection period (=1H: 1 horizontal scanning period) of the liquid crystal pixels PX of the initial row that requires polarity inversion, i.e. the pixel line L1, both the control signals CTL0 and CTL1 fall immediately after the start of the first half of 1H, which is equal to the group driving period G (=H/2), thereby to electrically connect all the signal lines X1, X4, X5, X8, X9, X12, . . . , and the signal lines X2, X3, X6, X7, X10, X11, . . . , to the output buffers D1, D2, D3, D4, D5, D6, . . . . Immediately before the end of the first half of 1H, the control signal CTL0 rises to electrically disconnect the signal lines X1, X4, X5, X8, X9, X12, . . . , from the output buffers D1, D2, D3, D4, D5, D6, . . . . Then, immediately before the end of the second half of 1H, the control signal CTL1 rises to electrically disconnect the signal lines X2, X3, X6, X7, X10, X11, . . . , from the output buffers D1, D2, D3, D4, D5, D6, . . . .

On the other hand, as shown in FIG. 3, in the selection period (=1H: 1 horizontal scanning period) of the liquid crystal pixels PX of a row that requires no polarity inversion, i.e. each of pixel lines L2 to L4, the control signal CTL0 fails immediately after the start of the first half of 1H, which is equal to the group driving period G (=H/2), thereby to electrically connect the signal lines X1, X4, X5, X8, X9, X12, to the output buffers D1, D2, D3, D4, D5, D6, . . . . Immediately before the end of the first half of 1H, the control signal CTL0 rises to electrically disconnect the signal lines X1, X4, X5, X8, X9, X12, . . . , from the output buffers D1, D2, 03, D4, D5, D6, . . . . Subsequently, the control signal CTL1 falls immediately after the start of the second half of 1H, which is equal to the group driving period G, thereby to electrically connect the signal lines X2, X3, X6, X7, X10, X11, . . . , to the output buffers D1, D2, D3, D4, D5, D6, . . . . Immediately before the end of the second half of 1H, the control signal CTL1 rises to electrically disconnect the signal lines X2, X3, X6, X7, X10, X11, . . . , from the output buffers D1, D2, D3, D4, D5, D6, . . . .

Attention is now paid to the potentials of the signal lines X1, X2, X3 and X4. If the signal lines X1 and X4, together with the signal lines X3 and X2, are electrically connected to the output buffers D1 and D2 in the first half of the selection period of the pixel line L1, the potentials of the signal lines X1 and X3 are inverted, for example, from the negative polarity to the positive polarity, and vary with the pixel voltage Vs output from the output buffer D1. At the same time, the potentials of the signal lines X4 and X2 are inverted, for example, from the positive polarity to the negative polarity, and vary with the pixel voltage Vs output from the output buffer D2. If the polarity inversion is completed in the first half of the selection period of the pixel line L1, the signal lines X1 and X4 are electrically disconnected from the output buffers D1 and D2, and the signal lines X1 and X4 are kept in the floating state until the signal lines X1 and X4 are electrically connected once again to the output buffers D1 and D2 in the selection period of the next pixel line L2. The signal lines X3 and X2 are not electrically disconnected from the output buffers D1 and D2 in the first half of the selection period of the pixel line L1 and vary in the second half of the selection period of the pixel line L1 with the positive pixel voltage Vs and negative pixel voltage Vs, which are output with the same polarities as in the first half of the selection period. If the polarity change is completed in the second half of the selection period of the pixel line L1, the signal lines X3 and X2 are electrically disconnected from the output buffers D1 and B2.

According to the above-described control, the potentials of the signal lines X1, X2, X3 and X4 are all polarity-inverted in the first half of the selection period of the pixel line L1. Thus, in the second half of the selection period of the pixel line L1 in which the signal lines X1 and X4 are in the floating state, there is no need to invert the polarities of the signal lines X2 and X3. Therefore, even if there is a capacitance-coupled path which extends from the signal line X2 to the signal line X1 via a parasitic capacitance Csd-R, the pixel electrode PE in the potential-retention state and a parasitic capacitance Csd-L and there is a capacitance-coupled path which extends from the signal line X3 to the signal line X4 via a parasitic capacitance Csd-L, the pixel electrode PE in the potential-retention state and a parasitic capacitance Csd-R, no conspicuous potential variation occurs in the signal lines X1 and X4 due to the polarity inversion of the potentials of the signal lines X2 and X3.

Figure 4:
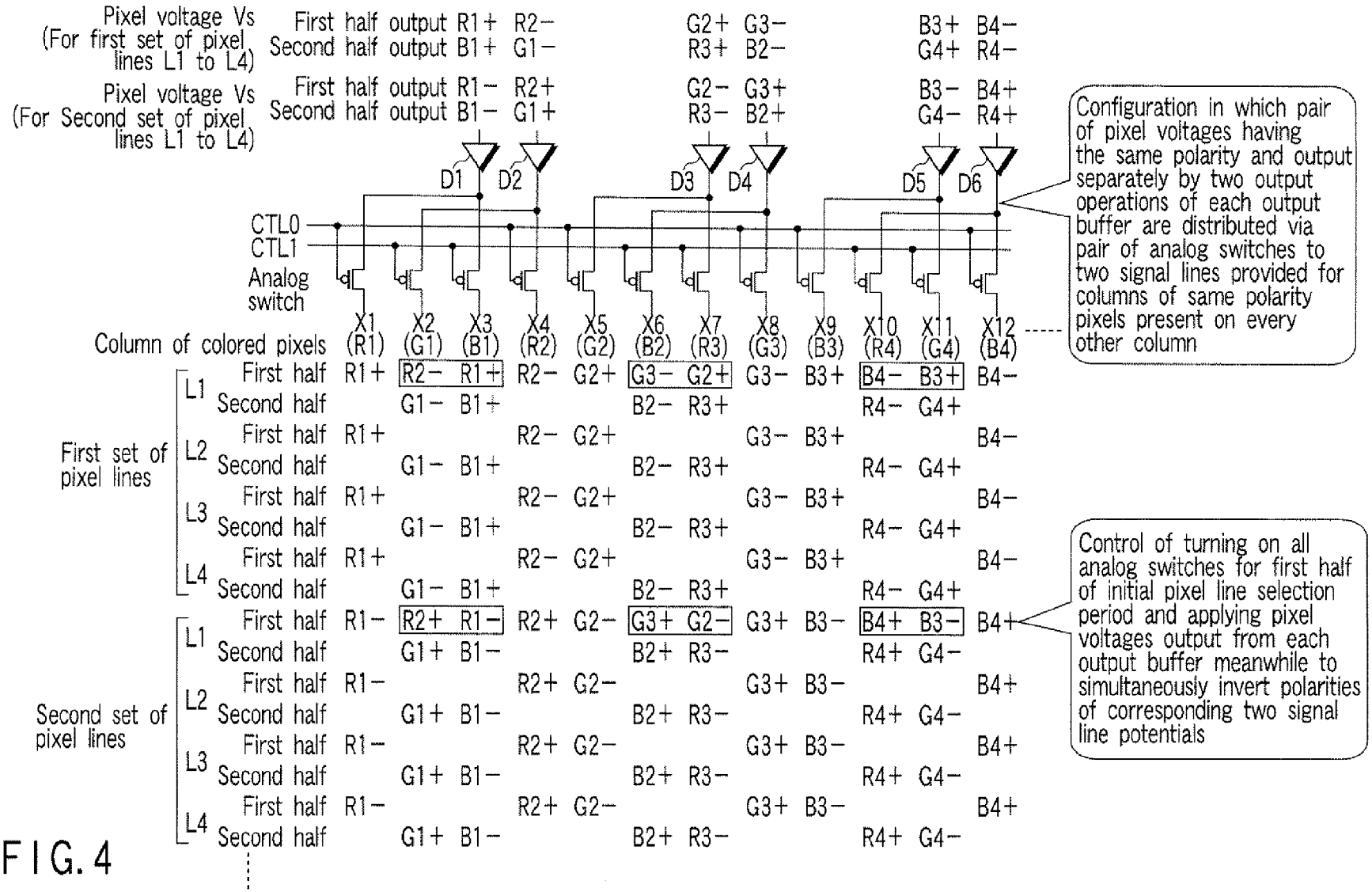
FIG. 4 shows potentials of signal lines set by using the multiplexer shown in FIG. 1.

FIG. 4 shows potentials of signal lines X set by using the above-described multiplexer 30. In FIG. 4, for example, R1+ represents a positive pixel voltage Vs for a red pixel R of a first column; R2− represents a negative pixel voltage Vs for a red pixel R of a second column; G2+ represents a positive pixel voltage Vs for a green pixel G of a second column; G3− represents a negative pixel voltage Vs for a green pixel G of a third column; B3+ represents a positive pixel voltage Vs for a blue pixel B of a third column; B4− represents a negative pixel voltage Vs for a blue pixel B of a fourth column; B1+ represents a positive pixel voltage Vs for a blue pixel B of a first column; G1− represents a negative pixel voltage Vs for a green pixel G of a first column; R3+ represents a positive pixel voltage Vs for a red pixel R of a third column; B2− represents a negative pixel voltage Vs for a blue pixel B of a second column; G4+ represents a positive pixel voltage Vs for a green pixel G of a fourth column; and R4− represents a negative pixel voltage Vs for a red pixel R of a fourth column. Pixel voltages Vs for other pixels are expressed according to the same rules.

The potentials of the signal lines X2, X3, X6, X7, X10, X11, . . . , of the second signal line group are set at R2+, R1−, G3+, G2−, B4+, B3−, . . . . , which are boxed in FIG. 4, respectively, in accordance with the pixel voltages Vs which are output from the output buffers D1, D2, D3, D4, D5, D6, . . . , in the first half of the selection period of a pixel line L1 of a second set of pixel lines. These potentials have polarities opposite to the polarities of G1−, B1+, B2−, R3+, R4−, G4+, . . . , which are set in the second half of the selection period of a pixel line L4 of a first set of pixel lines. Further, the potentials of the signal lines X2, X3, X6, X7, X10, X11, . . . , are set at G1+, B1−, B2+, R3−, R4+, G4−, . . . , respectively, in accordance with the pixel voltages Vs that are output from the output buffers D1, D2, D3, D4, D5, D6, . . . , in the second half of the selection period of the pixel line L1 of the second set.

According to the present embodiment, in the second half of the selection period of the pixel line L1 of the second set, the potentials of the signal lines X2, X3, X6, X7, X10, X11, . . . , are varied, without polarity inversion, from R2+, R1−, G3+, G2−, B4+, B3−, . . . , to G1+, B1−, B2+, R3−, R4+, G4−, . . . . If attention is paid to the signal line X2, the potential of the signal line X2 varies from R2+ to G1+. If it is assumed that R2+ and G1+ have the same values, it is possible to avoid the actual potential of the signal line X2 from varying in the second half of the selection period of the pixel line L1. The same applies to the other signal lines X3, X6, X7, X10, X11, . . . . Accordingly, in the case of solid display in which all of the red pixel R, green pixel G and blue pixel B are set at the same luminance, it is possible to prevent occurrence of a horizontal stripe which occurs when the liquid pixels of each row are driven in at least two steps.

However, in the case of single-color solid display of yellow, for instance, the potential of the signal line X3, for instance, varies from an intermediate gradation value corresponding to R1− to a minimum gradation value corresponding to B1− in the second half of the selection period of the pixel line L1 of the second set. This variation adversely affects a capacitive-coupled neighboring signal line, specifically, the signal line X4 or X5, which is in the floating state, and varies the potential of this neighboring line.

Figure 5:
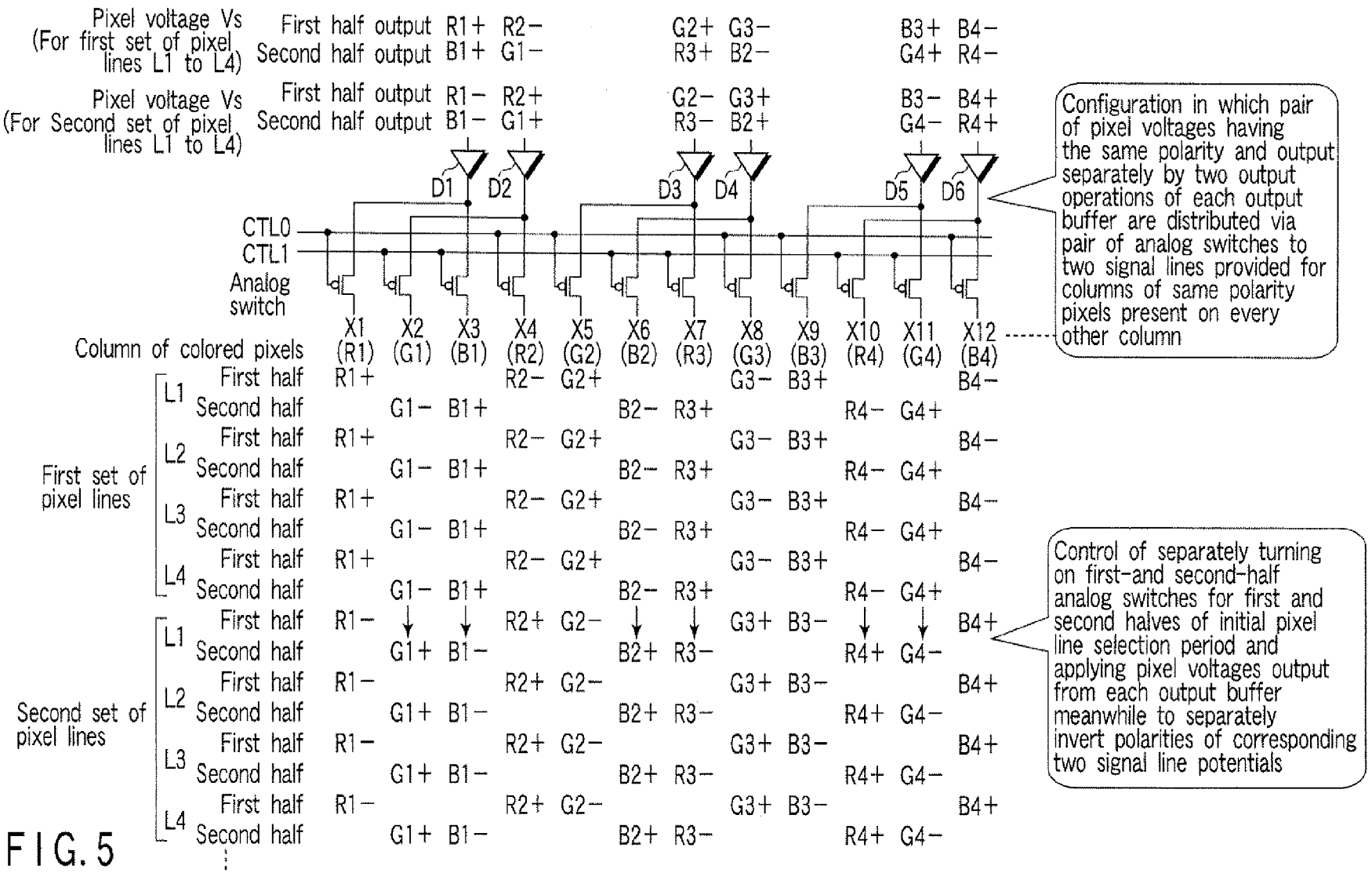
FIG. 5 shows potentials of signal lines set in the case where the multiplexer shown in FIG. 1 is controlled in a conventional manner.

In the meantime, FIG. 5 shows potentials of signal lines X in a case where the above-described multiplexer 30 is controlled in a conventional manner. In FIG. 5, pixel voltages Vs are expressed according to the same rules as in FIG. 4. The output buffers D1, D2, D3, D4, D5, D6, . . . , do not output pixel voltages Vs to the second signal line group, i.e. the signal lines X2, X3, X6, X7, X10, X11, . . . , in the first half of the selection period of the pixel line L1 of the second set. As a result, the potentials of the signal lines X2, X3, X6, X7, X10, X11, . . . , are kept at G1−, B1+, B2−, R3+, R4−, G4+, . . . , which are set in the second half of the selection period of the pixel line L4 of the first set. In the second half of the selection period of the pixel line L1 of the second set, if the output buffers D1, D2, D3, D4, D5, D6, . . . , output pixel voltages Vs to the signal lines X2, X3, X6, X7, X10, X11, . . . , the polarities of potentials of the signal lines X2, X3, X6, X7, X10, X11, . . . , are inverted from G1−, B1+, B2−, R3+, R4−, G4+, . . . , to G1+, B1−, B2+, R3−, R4+, G4−, . . . , as indicated by arrows in FIG. 5. This polarity inversion is executed while the first signal line group, i.e. signal lines X1, X4, X5, X8, X9, X12, . . . , are in the floating state. Consequently, even in the case of the solid display in which all of the red pixel R, green pixel G and blue pixel B are set at the same luminance, it is impossible to prevent occurrence of a horizontal stripe which occurs when the liquid pixels of each row are driven in at least two steps.

Next, a liquid crystal display device according to a second embodiment of the present invention is described with reference to the accompanying drawings.

Figure 6:
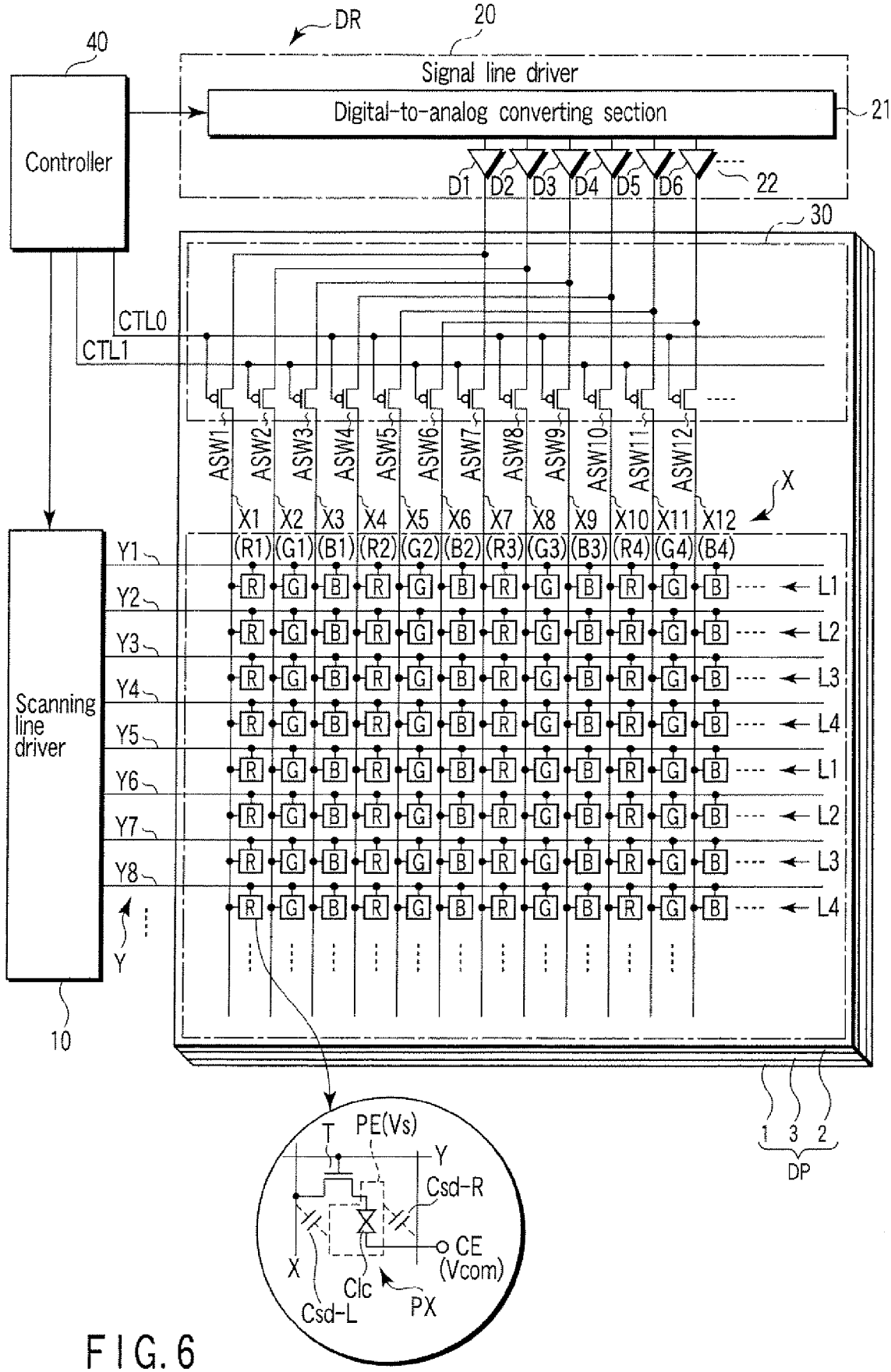
FIG. 6 schematically shows the circuit structure of a liquid crystal display device according to a second embodiment of the present invention.

FIG. 6 schematically shows the circuit structure of the liquid crystal display device. This liquid crystal display device is directed to preventing the occurrence of a horizontal stripe without being affected by restrictions such as the solid display in which all of the red pixel R, green pixel G and blue pixel B are set at the same luminance. The structure of the liquid crystal display device according to the second embodiment is the same as that of the liquid crystal display device of the first embodiment, except for the points described below. In FIG. 6, the parts common to those of the first embodiment are denoted by the same reference symbols, and a detailed description thereof is omitted.

In the liquid crystal display device shown in FIG. 6, the multiplexer 30 is configured such that two pixel voltages for the same color, having the same polarity and output separately by two output operations of each of the output buffers D1, D2, D3, B4, D5, D6 . . . , are distributed via a pair of analog switches to two signal lines provided for the columns of same color and polarity pixels present on every other sixth column. The multiplexer 30 is controlled to turn on all the analog switches for the first half of the selection period of the liquid crystal pixels PX of the initial row, i.e. the pixel line L1, and to apply pixel voltages output from each output buffer meanwhile, thereby simultaneously inverting the polarities of corresponding two signal line potentials. Specifically, the analog switches ASW1, ASW4, ASW5, ASW8, ASW9, ASW12, . . . , are connected between the signal lines X1, X4, X5, X8, X9, X12, . . . , of the first signal line group and the output buffers D1, D4, D5, D2, D3, D6, . . . , and are controlled by the control signal CTL0 supplied from the controller 40. The other analog switches ASW2, ASW3, ASW6, ASW7, ASW10, ASW11, . . . , are connected between the signal lines X2, X3, X6, X7, X10, X11, . . . , of the second signal line group and the output buffers D2, D3, D6, D1, D4, D5, . . . , and are controlled by the control signal CTL1 supplied from the controller 40. For example, if the control signal CTL0 falls, all the analog switches ASW1, ASW4, ASW5, ASW8, ASW9, ASW12, . . . , are turned on, thereby electrically connecting the signal lines X1, X4, X5, X8, X9, X12, . . . , to the output buffers D1, 04, D5, D2, D3, D6, . . . . On the other hand, if the control signal CTL1 falls, all the analog switches ASW2, ASW3, ASW6, ASW7, ASW10, ASW11, . . . , are turned on, thereby electrically connecting the signal lines X2, X3, X6, X7, X10, X11, . . . , to the output buffers D2, D3, D6, D1, D4, D5, . . . .

As shown in FIG. 3, in the selection period (=1H: 1 horizontal scanning period) of the liquid crystal pixels PX of the initial row that requires polarity inversion, i.e. the pixel line L1, both the control signals CTL0 and CTL1 fall immediately after the start of the first half of 1H, which is equal to the group driving period G (=H/2), thereby to electrically connect all the signal lines X1, X4, X5, X8, X9, X12, . . . , to the output buffers D1, D4, D5, D2, D3, D6, . . . , and the signal lines X2, X3, X6, X7, X10, X11, . . . , to the output buffers D2, D3, D6, D1, D4, D5, . . . . Immediately before the end of the first half of 1H, the control signal CTL0 rises to electrically disconnect the signal lines X1, X4, X5, X8, X9, X12, . . . , from the output buffers D1, D4, B5, D2, D3, D6, . . . . Then, immediately before the end of the second half of 1H, the control signal CTL1 rises to electrically disconnect the signal lines X2, X3, X6, X7, X10, X11, . . . , from the output buffers D2, D3, D6, D1, D4, D5, . . . .

On the other hand, in the selection period (=1H: 1 horizontal scanning period) of the liquid crystal pixels PX of a row that requires no polarity inversion, i.e. each of pixel lines L2 to L4, the control signal CTL0 falls immediately after the start of the first half of 1H, which is equal to the group driving period G (=H/2), thereby to electrically connect the signal lines X1, X4, X5, X8, X9, X12, . . . , to the output buffers D1, D4, D5, D2, D3, D6, . . . . Immediately before the end of the first half of 1H, the control signal CTL0 rises to electrically disconnect the signal lines X1, X4, X5, X8, X9, X12, . . . , from the output buffers D1, D4, D5, D2, D3, D6, . . . . Subsequently, the control signal CTL1 falls immediately after the start of the second half of 1H, which is equal to the group driving period G, thereby to electrically connect the signal lines X2, X3, X6, X7, X10, X11, . . . , to the output buffers D2, D3, D6, D1, D4, D5, . . . . Immediately before the end of the second half of 1H, the control signal CTL1 rises to electrically disconnect the signal lines X2, X3, X6, X7, X10, X11, . . . , from the output buffers D2, D3, D6, D1, D4, D5, . . . .

Figure 7:
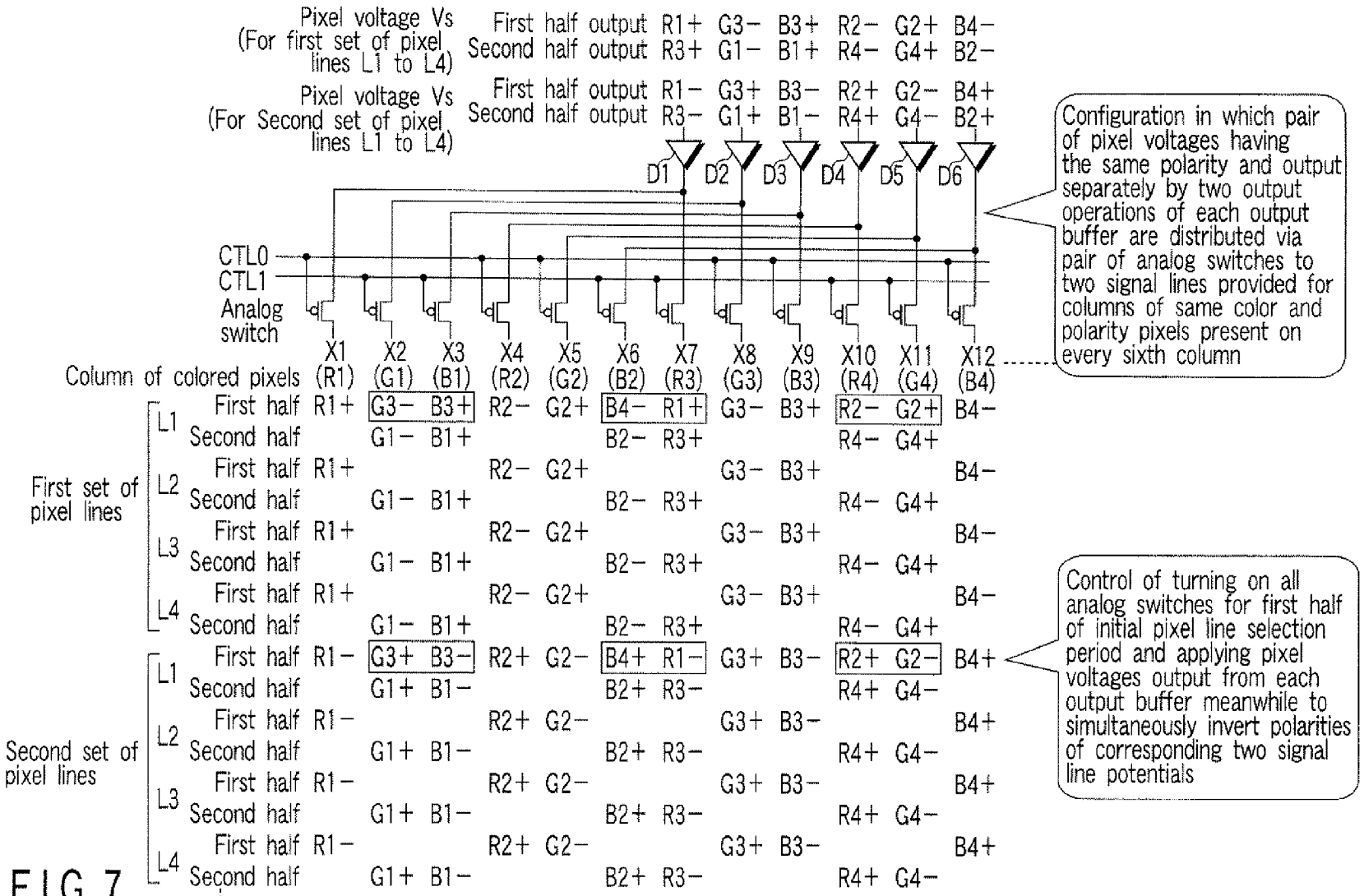
FIG. 7 shows potentials of signal lines set by using a multiplexer shown in FIG. 6.

FIG. 7 shows potentials of signal lines X set by using the above-described multiplexer 30. In FIG. 7, for example, R1+ represents a positive pixel voltage Vs for a red pixel R of a first column; G3− represents a negative pixel voltage Vs for a green pixel G of a third column; B3+ represents a positive pixel voltage Vs for a blue pixel B of a third column; R2− represents a negative pixel voltage Vs for a red pixel R of a second column; G2+ represents a positive pixel voltage Vs for a green pixel G of a second column; B4− represents a negative pixel voltage Vs for a blue pixel B of a fourth column; R3+ represents a positive pixel voltage Vs for a red pixel R of a third column; G1− represents a negative pixel voltage Vs for a green pixel G of a first column; B1+ represents a positive pixel voltage Vs for a blue pixel B of a first column; R4− represents a negative pixel voltage Vs for a red pixel R of a fourth column; G4+ represents a positive pixel voltage Vs for a green pixel G of a fourth column; and B2− represents a negative pixel voltage Vs for a blue pixel B of a second column. Pixel voltages Vs for other pixels are expressed according to the same rules.

The potentials of the signal lines X2, X3, X6, X7, X10, X11, . . . , of the second signal line group are set at G3+, B3−, B4+, R1−, R2+, G2−, . . . , which are boxed in FIG. 7, in accordance with the pixel voltages Vs that are output from the output buffers D2, D3, D6, D1, D4, D5, . . . , in the first half of the selection period of a pixel line L1 of a second set of pixel lines. These potentials have polarities opposite to the polarities of G1−, B1+, B2−, R3+, R4−, G4+, . . . , which are set in the second half of the selection period of a pixel line L4 of a first set of pixel lines. Further, the potentials of the signal lines X2, X3, X6, X7, X10, X11, . . . , are set at G1+, B1−, B2+, R3−, R4+, G4−, . . . , respectively, in accordance with the pixel voltages Vs that are output from the output buffers D2, D3, D6, D1, D4, D5, . . . , in the second half of the selection period of the pixel line L1 of the second set.

According to the present embodiment, in the second half of the selection period of the pixel line L1 of the second set, the potentials of the signal lines X2, X3, X6, X7, X10, X11, . . . , are varied, without polarity inversion, from G3+, B3−, B4+, R1−, R2+, G2−, . . . , to G1+, B1−, B2+, R3−, R4+, G4−, . . . . If attention is paid to the signal line X2, the potential of the signal line X2 varies from G3+ to G1+. Since G3+ and G1+ have values for the same color, it is possible to avoid the actual potential of the signal line X2 from varying in the second half of the selection period of the pixel line L1. The same applies to the other signal lines X3, X6, X7, X10, X11, . . . . Thus, in the case of solid display of a single color such as red, green or blue, or solid display of yellow, magenta or cyan obtainable by minimizing the gradation of any one of red, green and blue, it is possible to prevent a horizontal stripe from occurring when the liquid pixels of each row are driven in at least two steps.

The present invention is not limited to the above-described embodiments, and can be variously modified without departing from the spirit of the invention.

Figure 8:
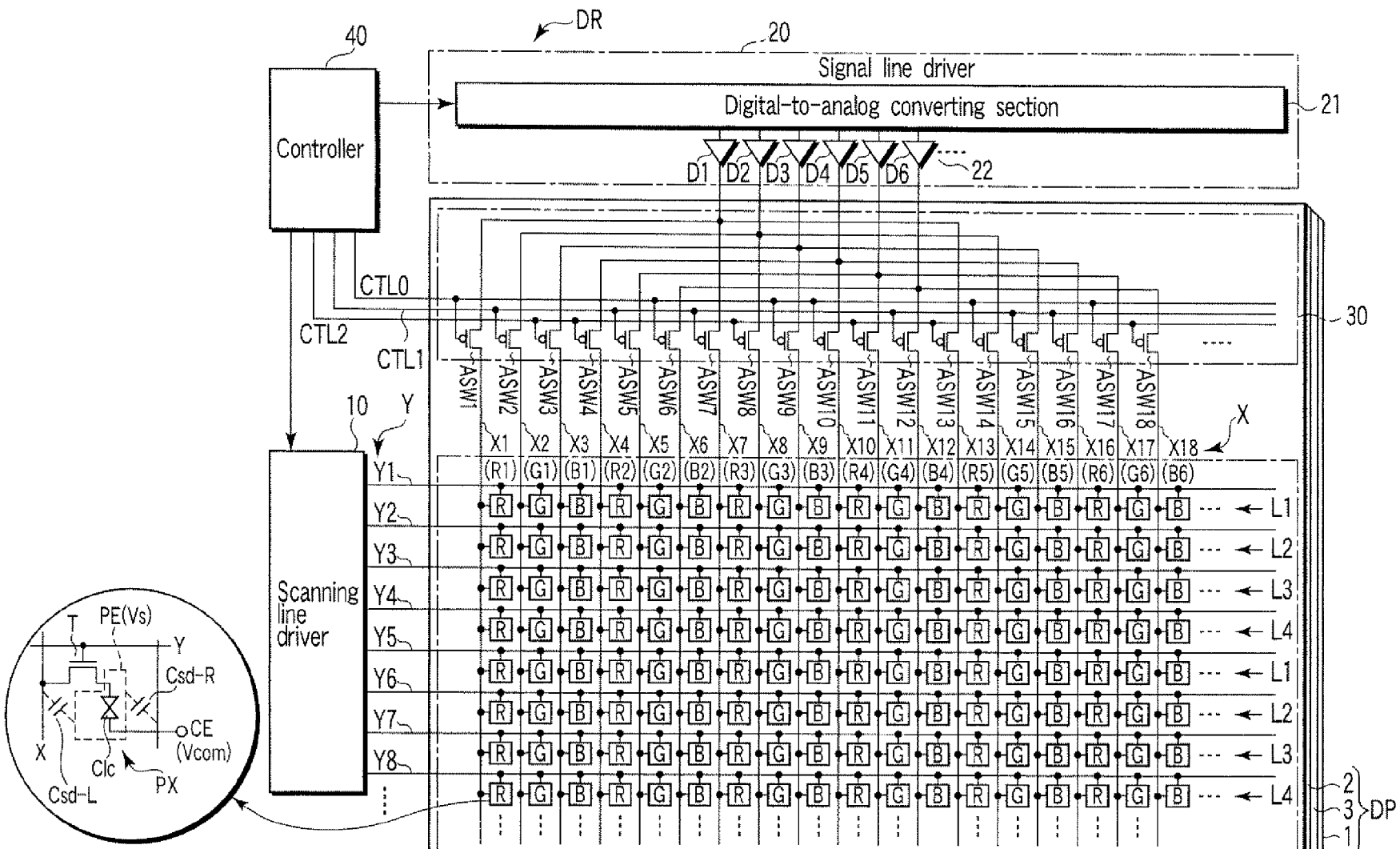
FIG. 8 is a view for explaining a modification of the multiplexer shown in FIG. 6.
Figure 9:
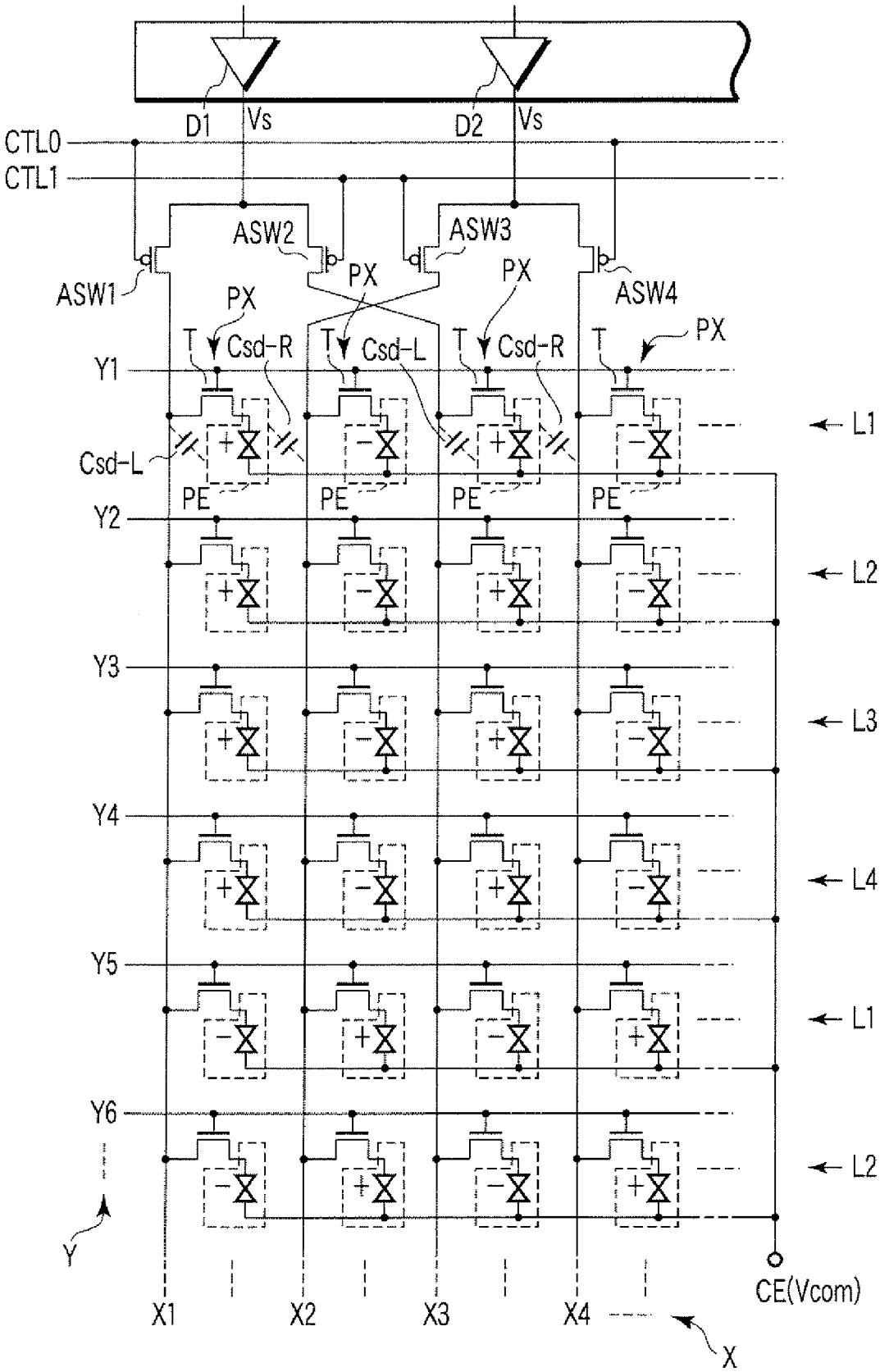
FIG. 9 is a view for explaining the structure and control method of a conventional multiplexer.
Figure 10:
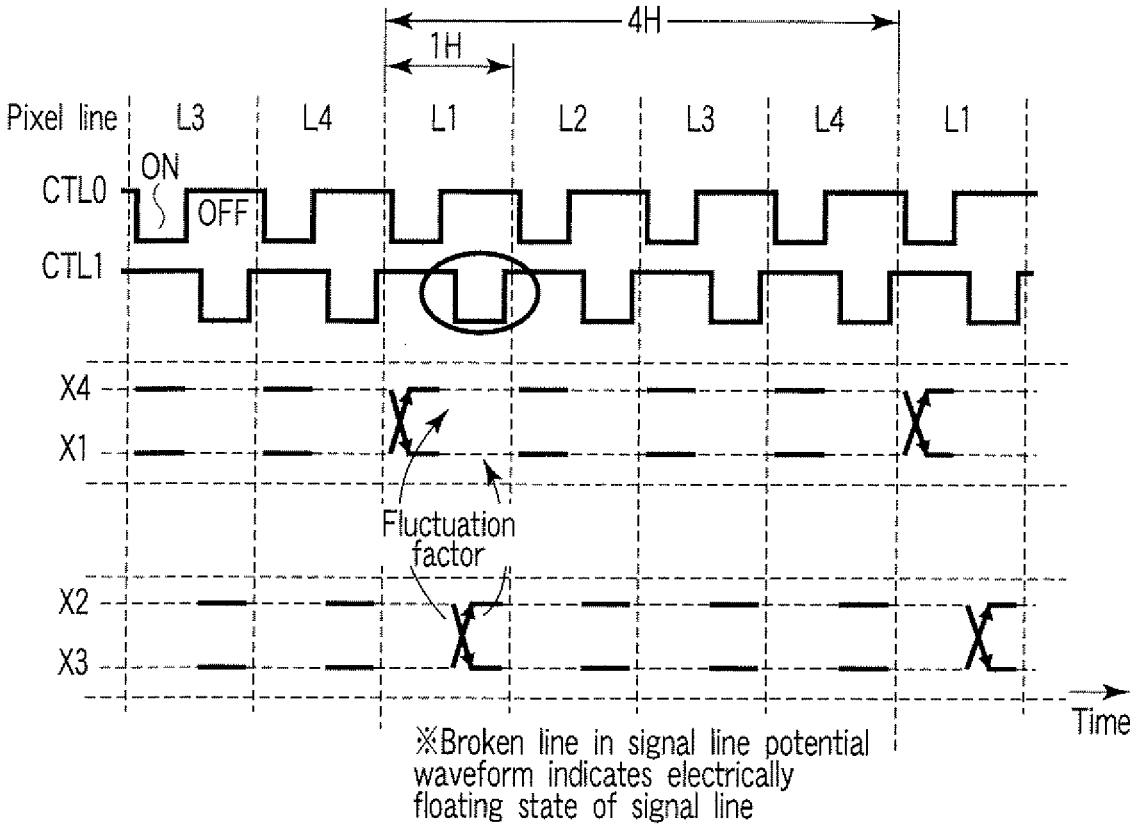
FIG. 10 is a waveform diagram showing potential variations in four signal lines, which occur due to the control of the multiplexer shown in FIG. 9.
Figure 11:
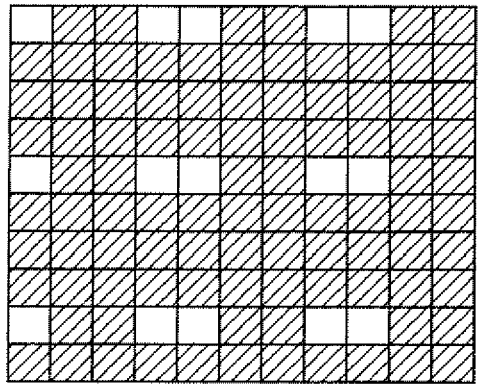
FIG. 11 shows horizontal stripes which occur due to potential variations shown in FIG. 10.

In the second embodiment, the multiplexer 30 is configured such that two pixel voltages output separately by two output operations of each of the output buffers D1, D2, D3, D4, D5, D6, . . . , are distributed two signal lines X. Alternatively, as shown in FIG. 8, for example, the multiplexer 30 may be configured such that three pixel voltages for the same color, having the same polarity and separately output by three output operations of each of the output buffers D1, D2, D3, D4, D5, D6 . . . , are distributed via a set of three analog switches to three signal lines (i.e. signal lines X1, X7 and X13; signal lines X2, X8 and X14; signal lines X3, X9 and X15; signal lines X4, X10 and X16; signal lines X5, X11 and X17; signal lines X6, X12 and X18; . . . ) for the columns of same color and polarity pixels (i.e. pixel columns R1, R3 and R5; pixel columns G1, G3 and G5; pixel columns B1, B3 and B5; pixel columns R2, R4 and R6; pixel columns G2, G4 and G6; pixel columns B2, B4 and B6) present on every sixth pixel column. In this case, control signals CTL0, CTL1 and CTL2 are supplied from the controller 40 to the multiplexer 30. All the set of three analog switches are controlled to turn on in a first ⅓ part of the selection period of the liquid crystal pixels PX of the initial row, i.e. the pixel line L1, and to apply pixel voltages Vs output from each of the output buffers D1, D2, D3, D4, D5, D6 . . . , meanwhile, thereby simultaneously inverting the polarities of corresponding three signal line potentials.

In the meantime, the multiplexer 30 may be configured such that four pixel voltages Vs, which are output in four steps from each of the output buffers D1, D2, D3, . . . , are distributed to four signal lines X, or a greater number of pixel voltages Vs, which are output in a greater number of steps, are distributed to a corresponding number of signal lines X.

Moreover, in each of the embodiments, the liquid crystal pixels PX are polarity-inverted in units of a predetermined number of pixel rows, i.e. four pixel rows. The invention is similarly applicable to cases where the liquid crystal pixels PX are polarity-inverted in units of two or more pixel rows, for instance, two pixel rows, three pixel rows, or five pixel rows.

The present invention is applicable to display modes of the liquid crystal display panel DP, which are known as, e.g. TN, OCB, MVA and IPS. In particular, in the OCB mode liquid crystal display panel DP, the present invention is applicable in combination with a black insertion driving scheme.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display device comprising:

a plurality of liquid crystal pixels which are arrayed substantially in a matrix;

a plurality of signal line groups each including a predetermined number of signal lines which are arranged along the columns of liquid crystal pixels; and a drive circuit which selects the liquid crystal pixels on a row-by-row basis and drives the liquid crystal pixels of the selected row via the signal lines;

wherein the drive circuit includes:

a signal line driver which outputs a predetermined number of pixel voltages, which are assigned to the predetermined number of signal lines included in each of the signal line groups, in a parallel fashion for each group driving period while the liquid crystal pixels of each row are being selected;

a multiplexer which distributes to each of the signal line groups the predetermined number of pixel voltages output from the signal line driver in the cycle of group driving period; and a controller which controls, in a case where output voltage polarities of the signal line driver are to be inverted in units of a predetermined number of pixel rows, the multiplexer to electrically connect all of the signal line groups to the signal line driver and electrically disconnect the signal line groups one by one from the signal line driver in a sequential fashion for each group driving period in a selection period of the liquid crystal pixels of an initial row that requires polarity inversion.

2. The liquid crystal display device according to claim 1, wherein the signal line driver includes a predetermined number of output terminals, which is equal to a fraction of an integer of 2 or more with respect to a total number of the signal lines, and the multiplexer includes a plurality of analog switches which supply, when all the signal line groups are to be connected to the signal line driver, the predetermined number of pixel voltages simultaneously output from the predetermined number of output terminals, to at least two of the signal lines, which correspond to the columns of the liquid crystal pixels which are to be driven with an identical polarity.

3. The liquid crystal display device according to claim 2, wherein the predetermined number of output terminals are output buffers having output voltage polarities each of which is opposite to that of a neighboring one of the output terminals.

4. The liquid crystal display device according to claim 3, wherein the output voltage polarities of the predetermined number of output buffers are inverted in units of any one of two pixel rows, three pixel rows, four pixel rows and five pixel rows.

5. The liquid crystal display device according to claim 1, wherein the signal line driver includes a predetermined number of output terminals, which is equal to a fraction of an integer of 2 or more with respect to a total number of the signal lines, and the multiplexer includes a plurality of analog switches which apply, when all the signal line groups are to be connected to the signal line driver, the predetermined number of pixel voltages output from the predetermined number of output terminals, to at least two of the signal lines for the columns of liquid crystal pixels of a same color to be driven in a same polarity.

6. The liquid crystal display device according to claim 5, wherein the predetermined number of output terminals are output buffers having output voltage polarities each of which is opposite to that of a neighboring one of the output terminals.

7. The liquid crystal display device according to claim 6, wherein the output voltage polarities of the predetermined number of output buffers are inverted in units of any one of two pixel rows, three pixel rows, four pixel rows and five pixel rows.

* * * * *